United States Patent [19]

Iannucci

[11] 4,081,870

[45] Apr. 4, 1978

[54] BOLSTER FOR PHYSICAL THERAPY

[76] Inventor: Anthony Iannucci, 192 Chatterton Pkwy., White Plains, N.Y. 10606

[21] Appl. No.: 683,496

[22] Filed: May 5, 1976

[51] Int. Cl.[2] ..... A47G 9/00; A61G 7/06

[52] U.S. Cl. ..... 5/340; 5/337; 5/338

[58] Field of Search ..... 5/340, 338, 337; 128/57, 69

[56] References Cited

U.S. PATENT DOCUMENTS

| | | | |
|---|---|---|---|
| 732,864 | 7/1903 | Jones | 5/340 |
| 793,477 | 6/1905 | Duzer | 5/340 |
| 2,593,056 | 4/1952 | Sage et al. | 5/340 |
| 3,378,860 | 4/1968 | Frazier | 5/340 |
| 3,802,704 | 4/1974 | Genua | 5/340 |

*Primary Examiner*—Paul R. Gilliam
*Assistant Examiner*—Victor N. Sakran
*Attorney, Agent, or Firm*—Spellman & Joel

[57] ABSTRACT

The present invention relates to a bolster which is used for physical therapy especially for handicapped children. The bolster comprises a pair of solid discs at the ends thereof and a plurality of spaced, hollowed-out intermediate discs having a cylindrical outer shell preferably of relatively light gauge metal wrapped thereabout. The cylindrical shell is then covered with a layer of foam rubber which is adhered thereto and turned over onto the periphery of the end discs. A brightly colored vinyl covering is then placed over the foam rubber. The operation may be facilitated by covering the foam rubber first with a plastic sheet or other low friction thin covering and slipping the vinyl thereover. The vinyl covering is secured in place to the end discs and a handle is fastened to one of the end discs for ease of handling. The resulting product is extremely sturdy, durable and light weight as well as being relatively inexpensive thus facilitating its use by handicapped individuals in physical therapy applications.

5 Claims, 2 Drawing Figures

BOLSTER FOR PHYSICAL THERAPY

BACKGROUND OF THE INVENTION

This invention relates to bolsters and particularly to bolsters which may be used by physical therapists in working with handicapped individuals.

The prior art discloses various bolsters which are used for conventional purposes and which are more in the line of upholstery using stuffed pillow type construction. Typical examples of prior art bolsters of somewhat greater interest are set forth in U.S. Pat. Nos. 691,119 to J. David, 793,477 to S. Van Duzer and 3,378,860 to F. C. Frazier.

The Van Duzer and David patents disclose bolsters which are not completely closed internally and they do disclose substantially circular spacer arrangements about which the bolster is wrapped. The overall construction is substantially different and the purposes for which these bolsters were designed limits their use.

The Frazier patent illustrates a bolster which has a center portion that is generally cylindrical in configuration and has a rigid inner frame or core over which cushioning material such as foam rubber is mounted. The patent does not disclose the internal construction of the present invention nor is suitable for the particular applications which the present invention is designed.

The present invention discloses a bolster which is extremely light weight and which may be used in physical therapy applications for handicapped individuals. The bolster is used to exercise various muscles by rolling on or straddling the bolster, etc. For use in such applications, the bolster must be extremely sturdy despite the light weight thereof and yet the price must be reasonable in order to facilitate wide spread adoption. The ease of production has also resulted in low cost for this extremely versatile physical therapy tool.

SUMMARY OF THE INVENTION

The present invention relates to a bolster for physical therapy and comprises a plurality of spaced discs of a material such as wood, the intermediate discs being hollow in order to obtain the goal of being light weight and the end discs being solid. A rigid covering such as thin gauge sheet metal is wrapped about the disc in order to form a cylindrical configuration of a predetermined length and a layer of foam rubber is adhered to the sheet metal covering by a suitable adhesive. A vinyl covering is then slipped in place over the sheet metal with a low friction plastic material being first placed over the foam rubber to facilitate slipping the vinyl in place. The foam rubber is folded over the ends of the cylinder and the vinyl is fastened to the end disc by suitable means. A handle is then mounted to one end of the roll.

Accordingly, an object of this invention is to provide a new and improved bolster for physical therapy.

Another object of this invention is to provide a new and improved bolster which is extremely light weight and sturdy so that it may be used by physical therapists in conjunction with therapy of handicapped individuals.

A more specific object of this invention is to provide a new and improved bolster for physical therapy having a hollow core formed by a metal sheet wrapped around spaced hollow discs and covered with a cushion material in a novel and expeditious manner to provide a light weight bolster for use particularly by handicapped children.

BRIEF DESCRIPTION OF THE DRAWINGS

Other objects and advantages may be seen from the following description when viewed in conjunction with the accompanying drawings wherein.

DETAILED DESCRIPTION OF THE INVENTION

Figure 1:
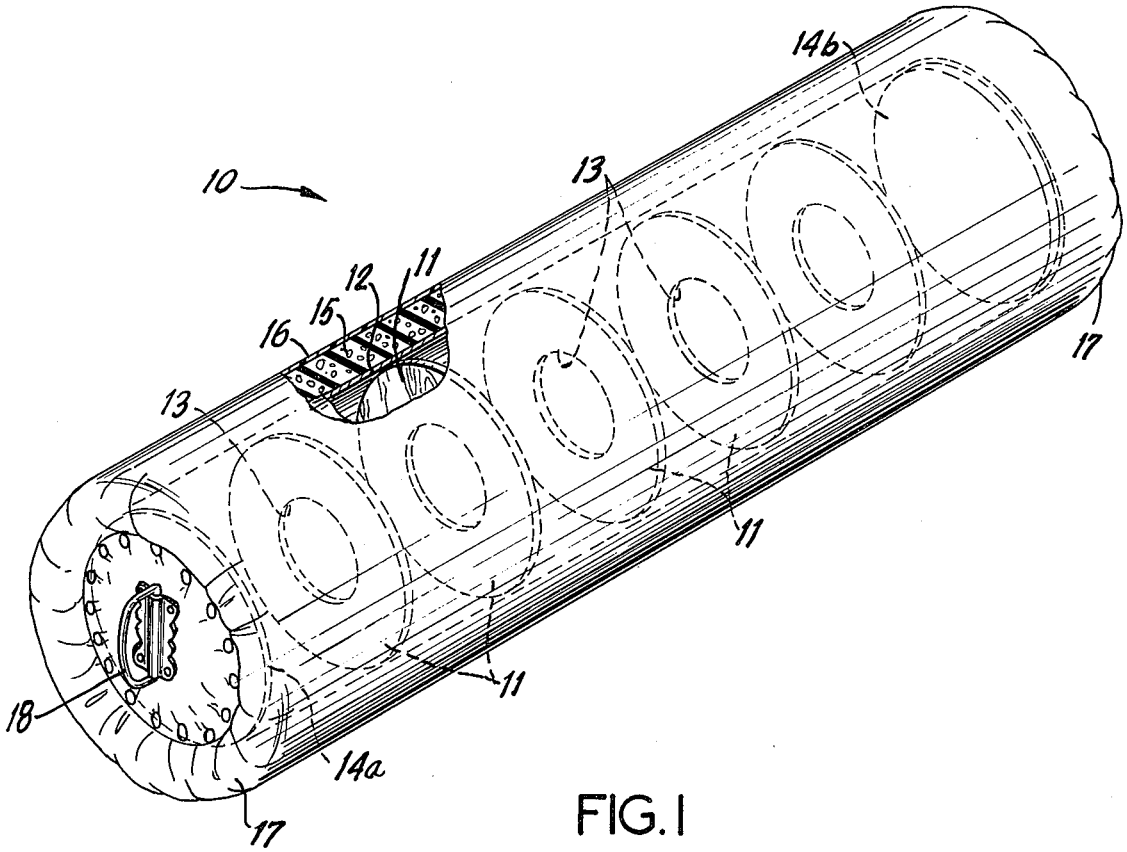
FIG. 1 is a perspective view of the bolster comprising the present invention, and, FIG. 2 is a cross-sectional view of the subject bolster.
Figure 2:
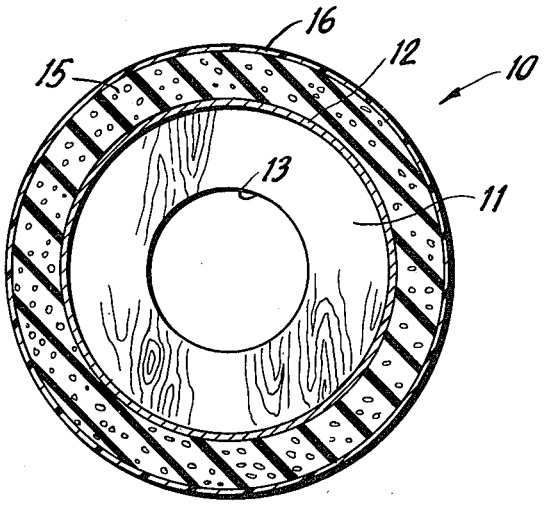

Referring now to FIG. 1 of the drawings, the invention comprises a bolster 10 for physical therapy applications which includes a plurality of spaced internal discs 11 having an outer covering of a light gauge metal such as a conventional sheet metal covering 12 wrapped thereabout and fastened to the discs. In a typical embodiment, the discs 11 would have a hollow interior 13 in order to minimize the weight of the bolster or alternatively the discs could include a plurality of apertures (not shown) for the same purposes. The end discs 14 *a* and 14 *b* are solid discs of wood or another suitable material generally spaced uniformly from the internal discs 11.

In the embodiment disclosed in the drawings, five intermediate discs 11 are disclosed and are spaced to form a bolster 10 approximately 48 inches long. The discs 11 are generally from ½ to ¾ inches wide to form a proper support for the covering layer of material 12. Alternatively, more or less discs 11 may be employed in order to make bolsters of various lengths. The spacing of the preferred embodiment is typical and is approximately 8 inches on centers.

The sheet metal covering 12 is wrapped about and fastened to the supporting discs 11 and is of thickness which is sufficient to withstand the weight of an adult who can stand or jump on the final product. Since the bolster must be easily handled in performing various exercises, a relatively light gauge sheet metal material is therefore preferred. A second layer 15 of foam rubber if mounted over the sheet metal layer 12 by a suitable adhesive. The layer 15 is turned over at the edges 17 onto the periphery of the end discs 14 *a* and 14 *b*. A thickness of approximately 2 inches of foam rubber is generally suitable for the bolster of the present invention.

The foam rubber 15 is then covered with a layer of vinyl plastic 16 which may be brightly colored in order to enhance the attractiveness of the bolster 10. The vinyl covering 16 may be an integral cylindrical covering which is slipped over the foam rubber 15 or it may be a sheet which is wrapped about the foam rubber 15 and then fastened in place. In the former case, a thin plastic sheet (not shown) or other low friction covering may be placed about the foam rubber to facilitate covering with the vinyl layer 16.

The discs 14 *a* and 14 *b* at both ends are covered with the vinyl also and the ends of the vinyl covering 16 are fastened to the solid coverings 14 *a* and 14 *b* by suitable means such as nailing. A handle 18 is mounted at one end to a disc 14 *a* or 14 *b* to facilitate handling of the bolster 10.

The bolster 10 thus described is extremely light weight and may be readily manufactured at low cost. It is also sturdy and durable and particularly suited for use in physical therapy. Furthermore, bolsters of varying lengths and widths can be produced by merely adding or subtracting the discs 11 or by varying the width of said discs 11, 14 *a* and 14 *b*.

While the invention has been explained by a detailed description of certain specific embodiments, it is understood that various modifications and substitutions can be made in any them within the scope of the appended claims which are intended also to include equivalents of such embodiments.

What is claimed is:

1. A light-weight bolster for physical therapy of handicapped individuals comprising:

a plurality of spaced intermediate supporting discs each having at least one aperture extending therethrough, and a pair of solid discs at the ends of the plurality of discs, one of said solid discs being spaced from the other discs at each end, a layer of thin gauge metal wrapped circumferentially about said discs and fastened thereto, said metal being sufficiently thin to permit ready handling by handicapped individuals, a layer of foam rubber wrapped circumferentially about and adhered to said layer of thin gauge metal, said foam rubber layer being slightly longer than the distance between the solid end discs, and being folded over at its ends onto the end discs, a layer of plastic material covering the foam rubber layer and being mounted to the solid end discs to hold the foam rubber layer in position and a layer of plastic material covering the exterior of the solid end discs, and, mounting means securing both the foam rubber layer to the solid end discs and the layer of plastic material thereto; the bolster further includes a handle mounted on at least one of the end discs to facilitate handling.

2. A bolster for physical therapy in accordance with claim 1 further including:

a thin plastic sheet mounted over the foam rubber to facilitate covering with the outer plastic cover, and wherein the outer plastic cover comprises an integral covering which is slid over the plastic sheet.

3. A bolster for physical therapy in accordance with claim 2 wherein:

the foam rubber layer comprises a layer of material approximately 2 inches thick and the outer plastic material comprises an integral plastic vinyl covering.

4. A bolster for physical therapy in accordance with claim 1 wherein:

the discs each comprise a wooden disc having a plurality of apertures extending therethrough to lessen the weight of said disc, and said disc are being approximately $\frac{1}{2}$ – $\frac{3}{4}$ inch in thickness for supporting the layer of thin guage metal.

5. A bolster for physical therapy in accordance with claim 1 wherein:

the vinyl plastic covering is nailed to the solid wood discs at the ends thereof and wherein said bolsters are approximately 48 inches in length, said discs being spaced approximately 8 inches apart on centers.

* * * * *